United States Patent [19]

Kobayashi et al.

[11] 4,209,495

[45] Jun. 24, 1980

[54] CATALYTIC CONVERTER SYSTEM FOR AN INTERNAL COMBUSTION ENGINE

[75] Inventors: Toshihiko Kobayashi; Hirohumi Michioka, both of Toyota, Japan

[73] Assignee: Toyota Jidosha Kogyo Kabushiki Kaisha, Toyota, Japan

[21] Appl. No.: 923,300

[22] Filed: Jul. 10, 1978

[30] Foreign Application Priority Data

Feb. 24, 1978 [JP] Japan ..... 53-22287

[51] Int. Cl.[2] ..... B01J 8/00; B05B 1/14

[52] U.S. Cl. ..... 422/176; 422/180; 422/220; 239/590.3; 239/598

[58] Field of Search ..... 422/176, 177, 180, 211, 422/220, 222; 239/589, 590.5, 592, 594, 590.3, 598, 599; 138/39, 37; 181/211, 250, 273; 60/274, 324

[56] References Cited

U.S. PATENT DOCUMENTS

| | | | |
|---|---|---|---|
| 1,821,956 | 9/1931 | Yee | 422/202 |
| 2,314,078 | 3/1943 | Crawford | 239/590.5 |
| 2,873,142 | 2/1959 | Zetterstromn | 239/590.3 |
| 3,479,146 | 11/1969 | Hockman et al. | 422/220 |
| 3,498,755 | 3/1970 | Borre | 422/220 |
| 3,597,166 | 8/1971 | Hochman | 239/590.5 |
| 3,749,130 | 7/1973 | Howitt et al. | 55/418 |
| 4,032,310 | 6/1977 | Ignoffo | 422/177 |
| 4,065,918 | 1/1978 | Rifkin | 422/177 |

*Primary Examiner*—R. E. Serwin
*Assistant Examiner*—Chris Konkol
*Attorney, Agent, or Firm*—Kenyon & Kenyon

[57] ABSTRACT

A catalytic converter system for purifying exhaust gas from an internal combustion engine has a catalytic converter of the so-called monolithic type having a catalytic body of a honeycomb shape. The body has an elongated cross-sectional-shaped inlet surface located transverse to the flow of exhaust gas. An exhaust pipe of a relatively small diameter has an end facing the inlet of the catalytic body. In order to direct the exhaust gas to the outermost portion of the elongated inlet of the catalytic body, the exhaust pipe is, on the end facing the inlet, provided with a guiding means for forming one opening on each side of the exhaust pipe in the direction along which the inlet of catalytic body is elongated. The exhaust gas in the exhaust pipe is partly diverted therefrom via the side openings toward the outermost peripheral portion of the inlet of the catalytic body. Accordingly, the catalytic converter can be used to effectively purify exhaust gas.

6 Claims, 18 Drawing Figures

CATALYTIC CONVERTER SYSTEM FOR AN INTERNAL COMBUSTION ENGINE

DESCRIPTION OF THE INVENTION

The present invention relates to a catalytic converter system of an internal combustion engine having a catalytic converter of the so-called monolithic type having a catalytic body of a honeycomb structure for effectively cleaning exhaust gas from the engine.

Known is a catalytic converter of the monolithic type, wherein the catalytic converter has a catalytic body of a honeycomb shape defining a plurality of passageways coated with a catalytic material. In order to effectively clean the exhaust gas by using this type of catalytic converter, it is necessary to direct the exhaust gas not only to the central portion but also to the peripheral portion of the catalytic body. In order to direct the exhaust gas to the outer portion of the catalytic body exhibiting a large diameter from an exhaust pipe exhibiting a small diameter, a prior art catalytic converter system is provided with a guiding plate or perforated plate arranged adjacent one end of the exhaust pipe so that the exhaust gas from the exhaust pipe is directed to every portion of the inlet of the catalytic body of a honeycomb shape. The guiding plate can be mounted onto an inner surface of a casing of the catalytic converter by any suitable means, such as welding.

However, the use of such a guiding plate causes the catalytic converter system to have an increased number of parts leading to an overall complicated and heavy structure. Furthermore, the prior art system exhibits drawbacks which cause the manufacturing costs to be high and the assembling of the system to be difficult.

An object of the present invention is to provide a catalytic converter system capable of overcoming the above-mentioned prior art drawbacks.

Another object of the present invention is to provide a monolithic type of catalytic converter system of a simple structure which is capable of effectively cleaning exhaust gas.

Another object of the present invention is to provide a low cost monolithic type of catalytic converter.

According to the present invention, an exhaust system of an internal combustion engine, adapted for purifying exhaust gas received from the engine is provided, said system comprising:

exhaust pipe means adapted for connecting with the engine for receiving exhaust gas therefrom;

catalytic converter means comprising a casing connected to the exhaust pipe means for receiving the exhaust gas therefrom, and a catalytic body of a honeycomb structure which is arranged in the casing, such catalytic body having an inlet located transverse to the flow of the exhaust gas, the exhaust pipe means having an end facing the inlet surface, the cross-sectional area of the inlet surface being larger than that of the exhaust pipe means, and;

guiding means which is integral with the end of the exhaust pipe means for controlling the flow of the exhaust gas directed from the exhaust pipe means to the inlet surface of the catalyst body so that the exhaust gas is uniformly received by outermost portion of the inlet surface. The guiding means controls the flow of the exhaust gas so that the exhaust gas is received by the outermost part of the catalytic body. Thus, the catalytic converter can effectively clean the exhaust gas. Since the guiding means is integral with the end of the exhaust pipe, the construction of the entire system is quite simple.

Hereinafter, the present invention is described by way of examples with reference to the attached drawings in which.

Figure 1:
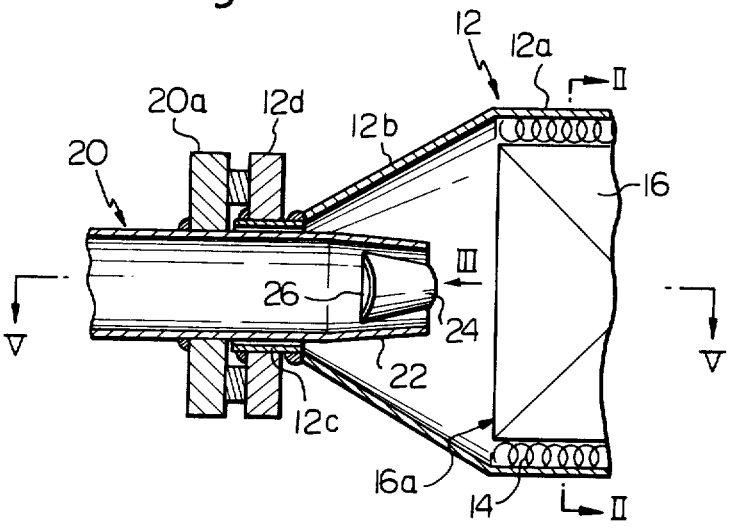
FIG. 1 is a longitudinal cross-sectional view of a catalytic converter system according to the present invention.
Figure 2:
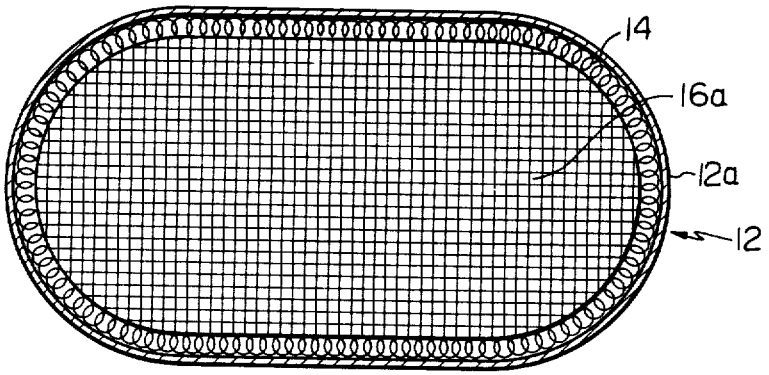
FIG. 2 is a cross-sectional view taken along the line II—II of FIG. 1.

In FIGS. 1 through 4 showing an embodiment of the present invention, a catalytic converter of the so-called monolithic type comprises a tubular casing 12 and a catalytic body 16 of a honeycomb structure having a plurality of passageways coated with the catalytic material, which are located parallel to the flow of exhaust gas. The catalytic body 16 forms, at an end facing the exhaust pipe 20, an inlet surface **16*a* which has, as shown in FIG. 2, a flattened elliptical cross-section elongated in the direction transverse to the exhaust gas flow. A layer of cushion material 14 is arranged around the catalytic body 16 in order to support the body 16 in the casing 12. The casing 12 of the catalytic converter has a portion 12*a* of a flattened elliptical shape as shown in FIG. 2, and a truncated cone-shaped front portion 12*b* which is converged toward the upstream side of the exhaust gas flow. Connected to the converging end of the front portion 12*b* is a pipe piece 12*c* of a circular cross-sectional shape exhibiting a small diameter. A flange member 12*d* is fixedly secured onto the outer surface of the pipe piece 12*c* by welding. Reference numeral 20 designates the exhaust pipe of an internal combustion engine adapted for receiving exhaust gas emitted from the combustion chambers in the body (not shown) of the engine. The exhaust pipe 20 has on one end located remote from the engine body a flange member 20*a* secured to the outer surface of the exhaust pipe 20 by welding. As shown in FIG. 1, the flange member 20*a* of the exhaust pipe 20 is connected to the flange member 12*d* of the converter casing 12 by any suitable means, for example, welding, or bolts and nuts. Therefore, exhaust gas in the exhaust pipe 20 is received by the catalytic body 16 in the casing 12** for cleaning.

According to the present invention, a guiding means is provided for controlling the flow of exhaust gas from the exhaust pipe 20 exhibiting a small diameter to the catalytic body 16 exhibiting a large diameter so that the exhaust gas is uniformly received by every portion of an inlet 16*a* of the catalytic body 16, so as to be effectively cleaned. As shown in FIG. 1, an end 22 of the exhaust pipe 20 is projected into the space in the casing 12 so that the end 22 faces the inlet 16*a* of the catalytic body 16. Furthermore, the end 22 has an elliptical cross-section of the catalytic body 16. In addition to this, the end 22 of the exhaust pipe 20 has, on both sides thereof in the direction of elongation, portions 24 which are projected inwardly from the inner surface of the exhaust pipe 20. The pipe 20 has a pair of side openings 26 at the projected inner end of each of the portions 24.

Figure 4:
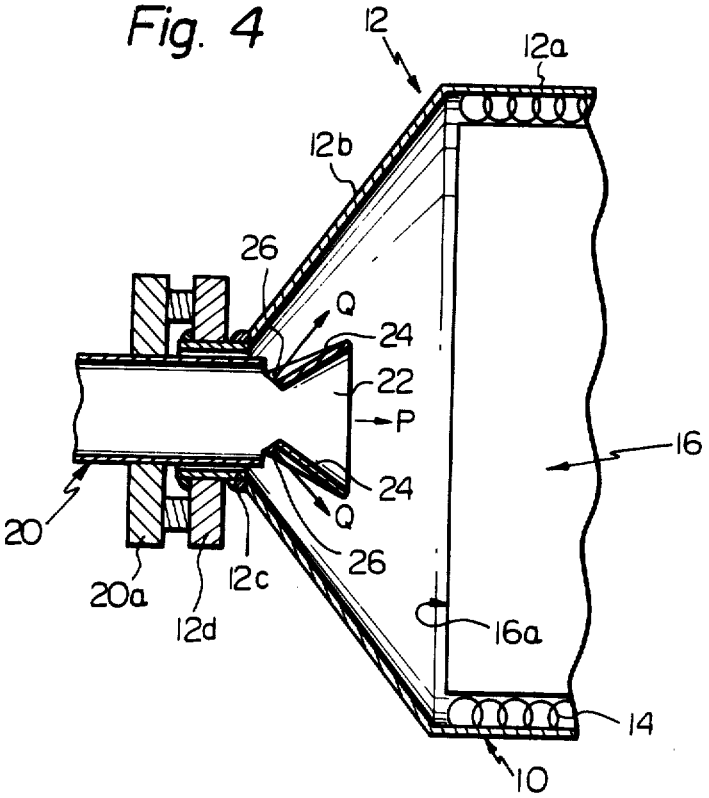
FIG. 4 is another longitudinal view of the system taken along the line V—V of FIG. 1.

The exhaust gas in the exhaust pipe 20 is, due to the existence of the guide projections (or portions) 24, partly diverted, as shown by the arrows Q in FIG. 4, via the side openings 26 located upstream of the guide projections 24. The thus diverted exhaust gas can reach the outermost peripheral portions of the flattened elliptically shaped inlet 16*a*, in the elongated direction. The exhaust gas which was not diverted to the side openings 26 is, via the end 22 of the pipe 20, directed to the central portion of the inlet 16*a*, as shown by the arrow P in FIG. 4.

Therefore, according to the present invention, the exhaust gas in the exhaust pipe 20 of the small circular cross-sectional shape can uniformly reach every portion of the inlet 16*a* of the catalytic body exhibiting the large diameter. Thus, the exhaust gas can pass uniformly through every passageway in the catalytic body and thus be cleaned effectively.

Figure 3:
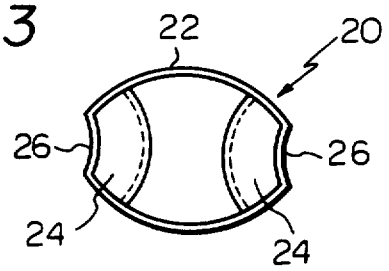
FIG. 3 is an end view taken in the direction of the arrow from III of FIG. 1.
Figure 5:
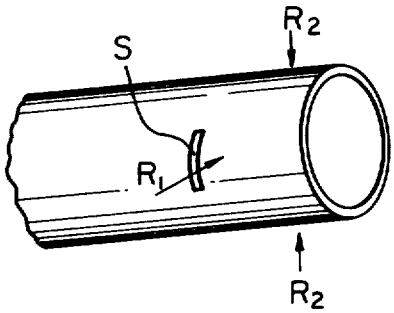
FIG. 5 is a perspective view illustrating the method for making the exhaust pipe shown in the first embodiment.

In order to produce the exhaust pipe according to the present invention, one slit S is formed on each side of the exhaust pipe 20 as shown in FIG. 5. Then, at a position near the slits S, the wall of the pipe 20 is inwardly depressed by exerting a force thereon as shown by the arrow R1 in FIG. 5. As a result, the side holes 26 as shown in FIGS. 1, 3, and 4 are obtained. Finally, a force is exerted on the pipe as shown by the arrows R2 in FIG. 5, so that a curved shape of the end 22 as shown in FIG. 3 is obtained.

The chief feature of the present invention resides in that the control of the direction of the exhaust gas flow is caused by the particular shape of the end 22 of the exhaust pipe 20. The required shape of the end 22 can be obtained by means of the simple operation and construction described with reference to FIG. 5. As a result, the construction of the exhaust system of the internal combustion engine according to the present invention can be simplified and manufactured at a low cost. Furthermore, assembling of the exhaust system can be easily carried out.

Figure 6:
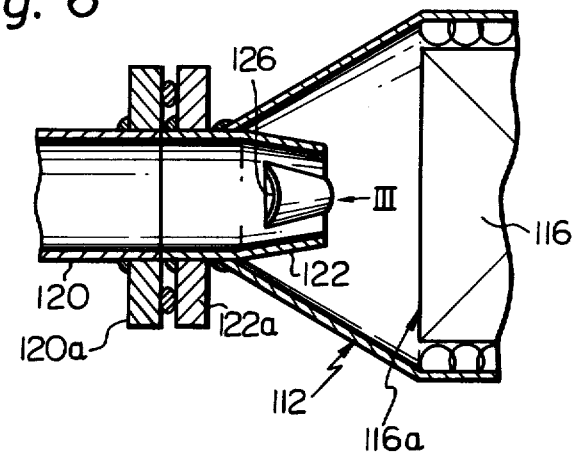
FIG. 6 is a longitudinal cross-sectional view, similar to FIG. 1, of another embodiment of the present invention.

In a modification of the embodiment according to the present invention, shown in FIG. 6, an exhaust pipe 120 is not extended to the space in a catalytic converter casing 112. A pipe piece 122 which is partially introduced into the casing 112 is secured thereto by welding. The exhaust pipe 120 and the converter casing 112 are connected to each other by a flange on the exhaust pipe 120 and a flange 122*a* on the pipe piece 122 of the casing 112. It should be noted that the pipe piece 122 of the exhaust pipe 120 facing an inlet 116*a* of a catalytic body 116 has substantially the same shape as the shape of the end portion 22 of the exhaust pipe 20 shown in FIGS. 1, 3 and 4. A pair of side holes 126 is formed, one hole on either side of the exhaust pipe 122, in substantially the same way as that described with reference to FIG. 5.

Figure 7A:
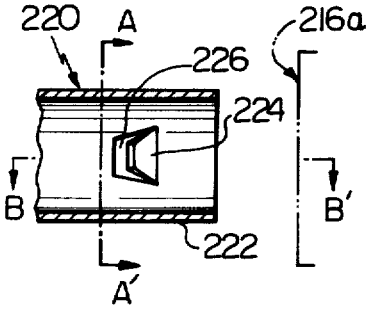
FIG. 7A is a cross-sectional view of an exhaust pipe in another embodiment of the present invention.
Figure 7B:
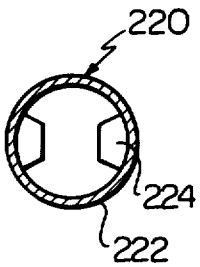
FIG. 7B is a cross-sectional view of the exhaust pipe shown in FIG. 7A taken along A—A' line of FIG. 7A.
Figure 7C:
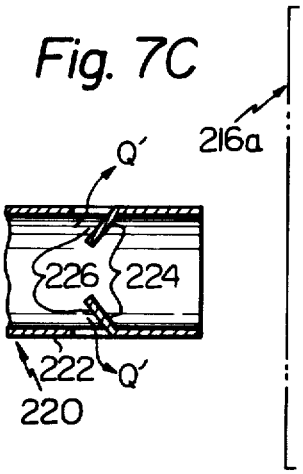
FIG. 7C is a cross-sectional view taken along the B—B' line in FIG. 7A.

FIGS. 7A, 7B and 7C show only an end 222 of an exhaust pipe 220 of another embodiment of the invention. Similar to the above-mentioned embodiments, this end 220 may be arranged so as to face the inlet 216*a* of the catalytic body. In this embodiment, the end 222 forms, in a cross-section transverse to the flow of exhaust gas, a circular shape as can be seen from FIG. 7B. However, it may also be possible to flatten the pipe end 222 so that it forms an elliptical shape. As is clear from FIGS. 7A and 7C, a portion of the pipe end 222 is, at the end remote from the catalytic body inlet 216A, projected inwardly from the inner surface of the pipe 220. Thus, a side opening 226 is respectively formed on each side of the pipe end 222. However, the shape of the portions 224 is different from that of the projections shown in FIGS. 1, 3 and 4. The side openings 226 are formed by forming substantially C-shaped slits on the blank pipe 220 and then depressing the wall of the pipe 220 so that the inner projections 224 are formed.

During operation of the system as shown in FIGS. 7A, 7B and 7C, the exhaust gas in the pipe 220 is partly diverted therefrom, as shown by the arrows Q' shown in FIG. 7C, toward the outermost peripheral portion of the inlet 216*a* of the catalytic body of a flattened elliptical shape. Therefore, the catalytic converter can be used to effectively purify the exhaust gas.

Figure 8A:
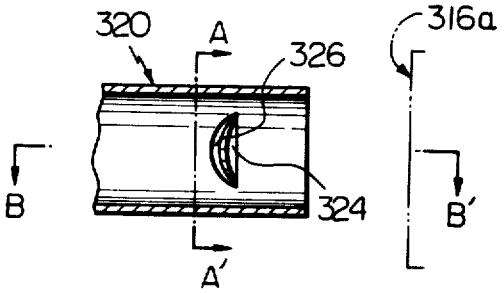
FIGS. 8A, 8B and 8C are views similar to FIGS. 7A, 7B and 7C, respectively, of another embodiment of the present invention.
Figure 8B:
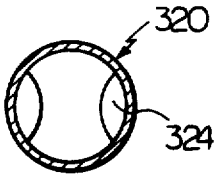
Figure 8C:
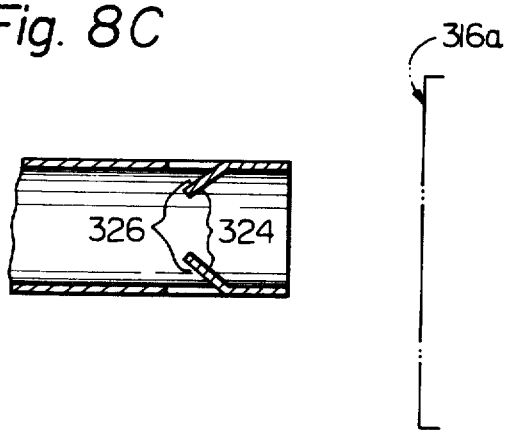

Another embodiment of the present invention shown in FIGS. 8A, 8B and 8C has a pair of projected portions 324 which define a pair of side openings for diverting a part of the exhaust gas from the exhaust pipe 320 to the outermost peripheral portion of the inlet 316*a* of the flattened elliptically-shaped catalytic body.

Figure 9A:
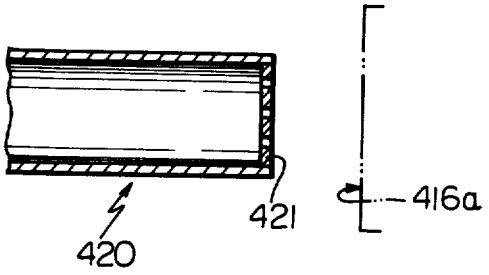
FIGS. 9A, 9B and 9C are views similar to FIGS. 7A, 7B and 7C, respectively, showing another embodiment of the present invention.
Figure 9B:
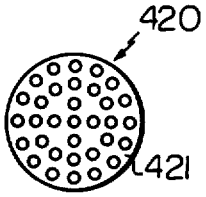
Figure 9C:
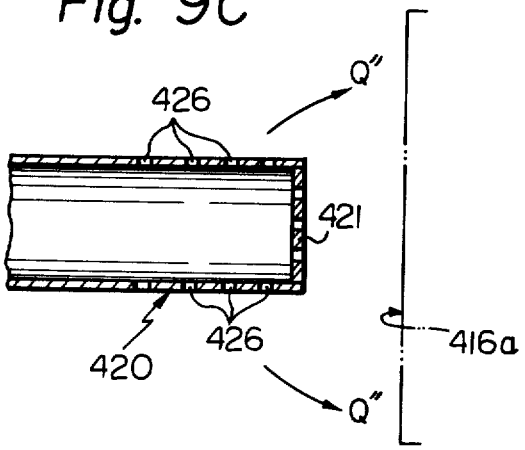

FIGS. 9A, 9B and 9C show another embodiment of the present invention. In order to control the flow of exhaust gas so that the exhaust gas is received uniformly by every portion of the embodiment, the embodiment is, first of all, provided with a perforated end plate 421 mounted onto the end of exhaust pipe 420. Secondly, the exhaust pipe 420 has, on both sides thereof in a direction along which the inlet 416*a* of the catalytic body is elongated, a plurality of side holes 426 exhibiting a small diameter.

The exhaust gas from the engine (not shown) is partly passed through the perforated end plate 421 toward the center of the inlet surface 416*a* of the catalytic body, and is partly diverted from the pipe 420 toward the outermost peripheral portion, of the inlet surface 416*a* via the side holes 426, as shown by the arrows Q".

Figure 10A:
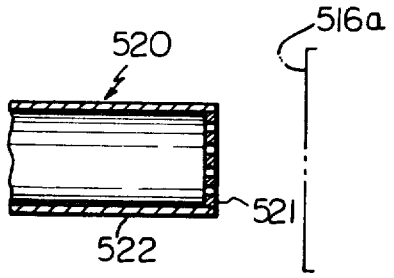
FIGS. 10A, 10B and 10C are views similar to FIGS. 7A, 7B and 7C, respectively, showing a further embodiment of the present invention.
Figure 10B:
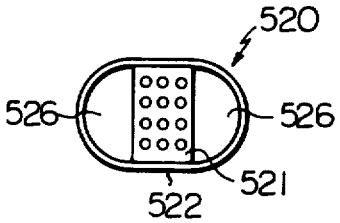
Figure 10C:
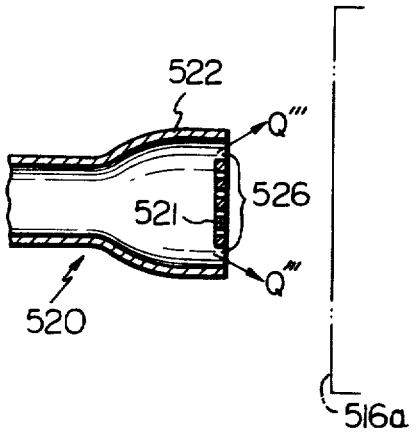

In a further embodiment of the present invention shown in FIGS. 10A, 10B and 10C, an end 521 of an exhaust pipe 520 has, as is clearly shown in FIG. 10B, a flattened elliptical shape. A rectangular-shaped perforated plate 521 is fixedly secured to the open end of the pipe so that a side opening 526 is respectively formed on each side of the plate 521 in the elongated direction of the catalytic body inlet 516*a*.

As a result, exhaust gas from the exhaust pipe 520 can reach the outermost peripheral portion of the inlet 516*a* of the catalytic body via the side openings 526 as shown by the arrows Q''' in FIG. 10C.

The inventors wish to state that many modifications and changes can be made to the present invention by those skilled in this art without departing from the scope of the invention.

What is claimed is:

1. An exhaust system for an internal combustion engine, adapted for purifying exhaust gas received from the engine, said system including exhaust pipe means adapted for connecting with said engine for receiving exhaust gas therefrom;

catalytic converter means comprising a casing connected to said exhaust pipe means for receiving exhaust gas therefrom and a catalytic body of a honeycomb structure which is arranged in said casing, said catalytic body having an inlet face transverse to the flow of exhaust gas, said exhaust pipe means having a downstream end facing said inlet face, and the area of said inlet face being larger than the cross-sectional area of the downstream end of said exhaust pipe means; and guiding means for distributing the flow of exhaust gas directed from said exhaust pipe means to said inlet face of said catalytic body so that exhaust gas is uniformly received by all portions of said inlet face, wherein the improvement comprises:

said exhaust pipe means having an end portion formed from a one-piece pipe member and located within the casing of the catalytic converter means, and the guiding means is formed entirely by the wall of said end portion of said exhaust pipe means.

2. A system according to claim 1, wherein said inlet face is elongated in a direction transverse to the flow of exhaust gas, and said guiding means comprises a pair of openings formed in the end portion of the exhaust pipe means, respectively on opposite sides thereof on a line parallel to the direction along which said inlet face is elongated, such that a part of the exhaust gas flow is diverted toward the outer peripheral portions on the axis of elongation of said inlet face of said catalytic body.

3. A system according to claim 2, wherein said guiding means comprises opposed portions of the wall of the end portion of the exhaust pipe means being deformed to project inwardly from the inner surface of the end portion of said exhaust pipe means, such that the upstream ends of said opposed wall portions are deformed inwardly more than the downstream ends thereof, and said pair of opposite side openings is located at the ends of the deformed opposed wall portions located remote from said inlet surface of said catalytic body, whereby said deformed opposed wall portions serve to deflect said diverted part of the exhaust gas flow outwardly through said pair of openings.

4. A system according to claim 2, wherein the downstream end of said exhaust pipe means has a substantially elliptical shape elongated in a direction parallel to the direction of elongation of said inlet face.

5. A system according to claim 1, wherein said exhaust pipe means including said end portion and said guiding means is formed from a one-piece pipe member.

6. An exhaust system according to claim 1, wherein the guiding means does not extend beyond the downstream end of the end portion of the exhaust pipe means.

* * * * *